US009038333B2

(12) United States Patent
Campbell

(10) Patent No.: US 9,038,333 B2
(45) Date of Patent: May 26, 2015

(54) COMMON WINDOW FRAME

(71) Applicant: Ply Gem Industries, Inc., Cary, NC (US)

(72) Inventor: Colin David Campbell, Daleville, VA (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 14/273,215

(22) Filed: May 8, 2014

(65) Prior Publication Data

US 2014/0331574 A1 Nov. 13, 2014

Related U.S. Application Data

(60) Provisional application No. 61/820,933, filed on May 8, 2013.

(51) Int. Cl.

| | |
|---|---|
| ***E06B 3/44*** | (2006.01) |
| ***E06B 7/16*** | (2006.01) |
| ***E06B 1/36*** | (2006.01) |
| ***E06B 1/70*** | (2006.01) |

(52) U.S. Cl.
CPC . *E06B 7/16* (2013.01); *E06B 1/366* (2013.01); *E06B 1/702* (2013.01); *E06B 3/44* (2013.01)

(58) Field of Classification Search
CPC ..... E06B 3/44; E06B 1/6007; E06B 3/08
USPC ..... 52/202, 203, 204.1, 204.5, 204.2, 52/204.51, 204.54, 204.55, 211, 212, 52/204.593, 204.595, 204.6; 49/501, 504, 49/404, 176, 181, 445
See application file for complete search history.

(56) References Cited

U.S. PATENT DOCUMENTS

| | | | | |
|---|---|---|---|---|
| 4,229,905 | A * | 10/1980 | Rush | 49/143 |
| 5,806,256 | A * | 9/1998 | Byrne | 52/204.5 |
| 6,966,158 | B1 * | 11/2005 | Christensen | 52/213 |
| 7,146,769 | B1 * | 12/2006 | Culverson | 52/204.5 |
| 2009/0199496 | A1 * | 8/2009 | Garries et al. | 52/213 |

* cited by examiner

*Primary Examiner* — Jeanette E Chapman
*Assistant Examiner* — Daniel Kenny
(74) *Attorney, Agent, or Firm* — Lathrop & Gage LLP

(57) ABSTRACT

Disclosed is an operating-fixed-operating window with a common frame. The window frame includes a sill with a sill lock and sill tower upwardly extending from the sill. The window frame also includes a head disposed atop the window frame, at least one jamb and at least one operating window frame. The window also includes at least one fixed window frame with a sill cover disposed atop the sill, the sill cover engaged with the sill lock and the sill tower.

21 Claims, 3 Drawing Sheets

COMMON WINDOW FRAME

RELATED APPLICATION

This application claims the benefit of priority to U.S. Provisional Application No. 61/820,933 filed May 8, 2013.

TECHNICAL FIELD

This disclosure relates generally to a window frame insert which allows an integral frame to simultaneously accommodate at least one operating window and at least one fixed window. This design allows the occupant to have a large unobstructed viewing area through a fixed center window and yet to also have operating windows on one or preferably both sides of the fixed window that may be opened for ventilation as desired. The operating windows also include a fixed glazing above the operating window which provides a clear line of sight without obstruction by any horizontal rails and also allows the lower operating glazing to open upwardly on a track located behind the fixed glazing. This common mull frame also provides extremely robust measures to prevent infiltration of driving rain thereby keeping the interior of the structure free of water.

For the foregoing reasons, there is a need for a common window frame with an arrangement of two operating windows separated by a fixed center window.

For the foregoing reasons, there is a need for a main frame window insert where the operating windows and fixed windows utilized the same mull and sill and also provide a robust resistance to driving water intrusion.

For the foregoing reasons, there is a need for an operating-fixed-operating window configuration wherein the interior sill cover of the fixed frame portion of the window is integral with the sill tower and fully obscures the fin-seal (weather seal) of the sill tower.

SUMMARY

The present disclosure is directed to a common mull window frame that includes a single fixed glazing between two operating units that may be single hung windows wherein the lower sash slides up from the bottom to allow ventilation to enter the room. Alternatively, the lower operating window on each side may also be double hung unit.

Various objects, features, aspects and advantages of the inventive subject matter will become more apparent from the following detailed description of preferred embodiments, along with the accompanying drawings in which like numerals represent like components.

DETAILED DESCRIPTION

Before describing the disclosed technology in detail, several terms used in the context of the present technology will be defined. In addition to these terms, others are defined elsewhere in the specification, as necessary. Unless otherwise expressly defined herein, terms of art used in this specification will have their art-recognized meanings.

Frame: Outer structure of a window or door that holds the sash or panel in position.

Glazing: Glass in a window sash.

Jamb: portion of the frame that runs vertically between the header and sill.

Rail: Horizontal components of a window sash or door panel framework.

Sash: Rail, stile and glass components joined together to form the venting capability of a window.

Sill: Horizontal member that forms the bottom of a window or door frame.

Figure 1:
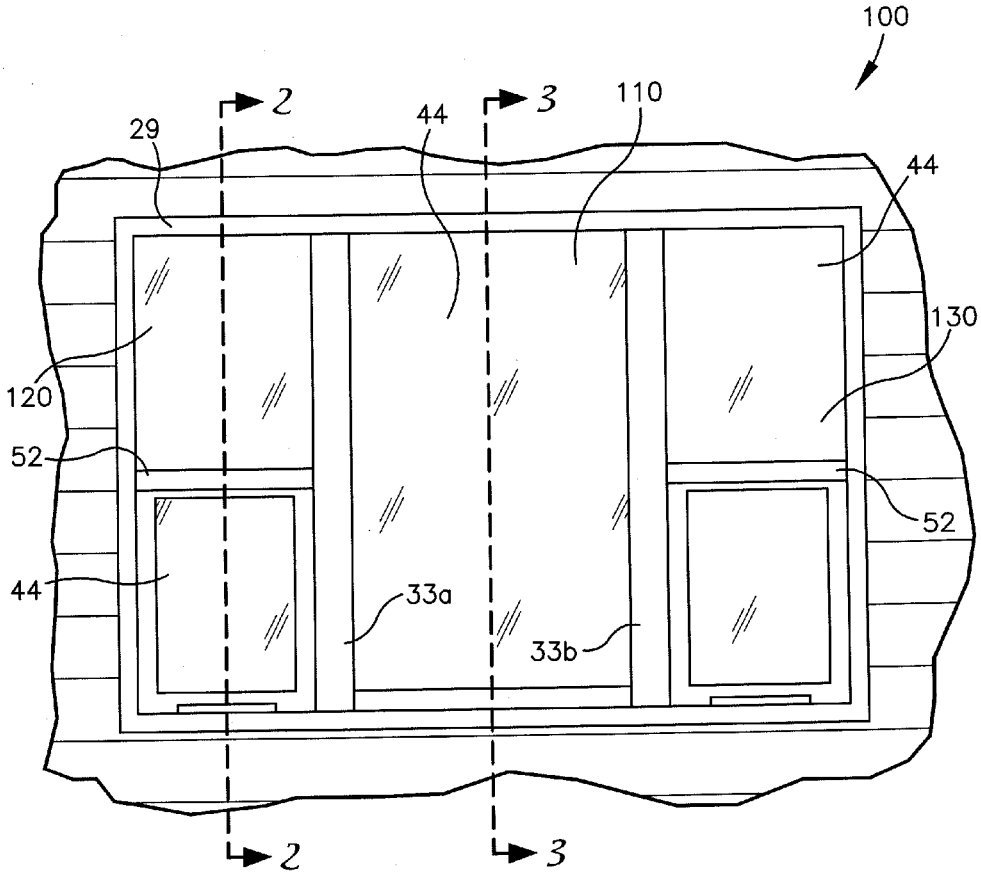
FIG. 1 is an elevation view of the exterior of an embodiment of an operating-fixed-operating window configuration.

The disclosed technology is directed to a common frame window incorporating a fixed glazing between two operating windows wherein a sill cover provides a base for the fixed glazing wherein the sill cover rests atop the sill. FIG. 1 is an exterior view of an operating-fixed-operating window unit 100. The fixed center glazing 110 is surrounded on each side by operating windows 120, 130. The window unit includes a head 29, glazing 44, and a meeting rail 52.

Figure 2:
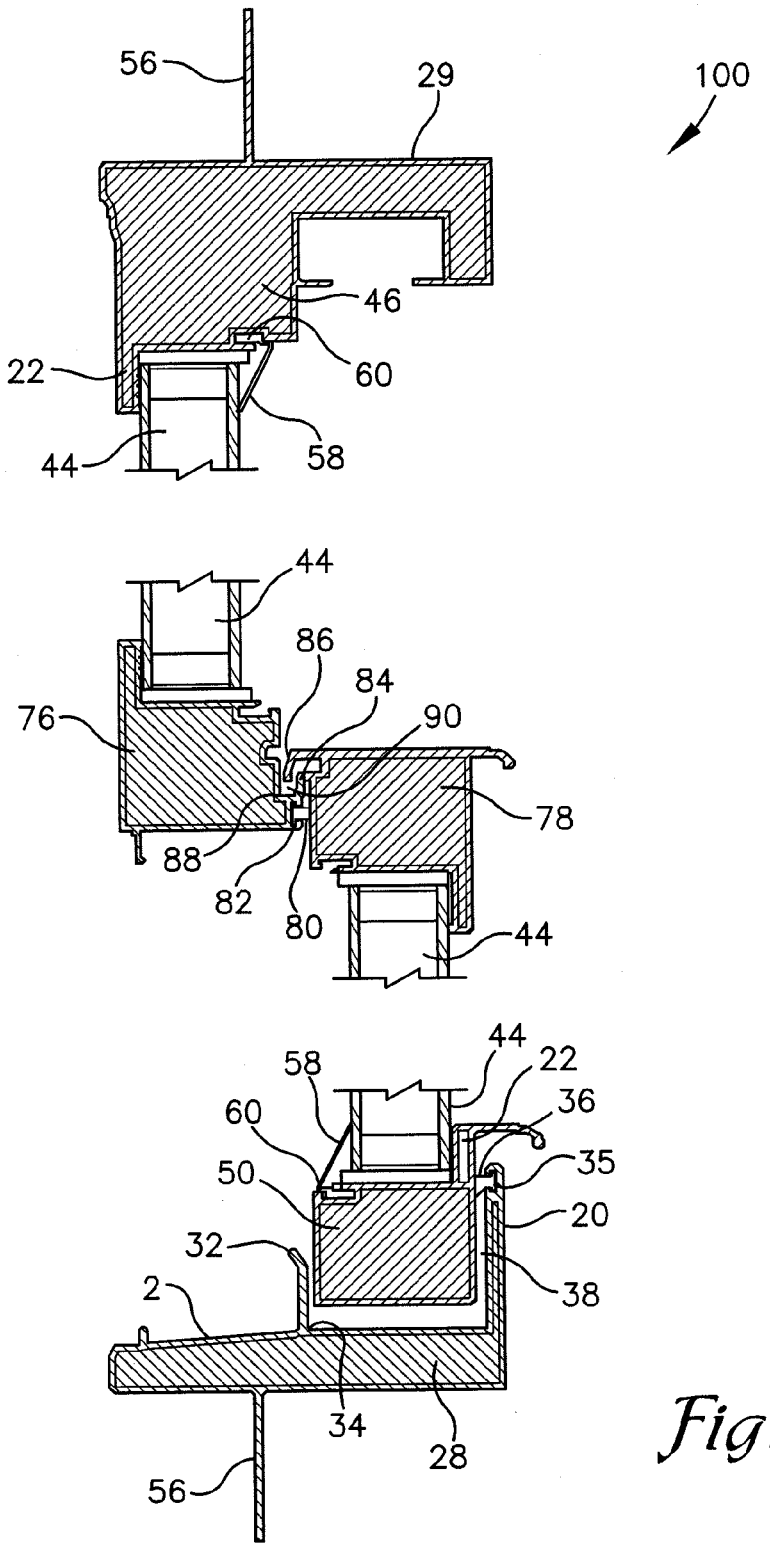
FIG. 2 is a cross sectional view taken along line 2-2 of FIG. 1 revealing an embodiment of a fixed upper glazing and an operating lower sash.

FIG. 2 is a cross-sectional view of FIG. 1 at line 2-2. The upper portion of the cross-sectional view reveals a fixed glazing 44 in position in the window unit 100. The window unit 100 also includes a nailing fin 56 a head 29 and glazing 44 held in position by a plurality of glazing beads 58, preferably spring clips that are secured in slots 60 in the head 29. The glazing beads 58, when inserted into slots 60 exert pressure against the glazing 44 forcing the glazing against a glazing leg 22 extending downwardly from the head 29. The fixed upper glazing 44 in the left and right operating window assembly 120, 130 are static and do not slide in contrast to the lower glazing 44 which may move vertically as desired by the operator.

FIG. 2 also reveals that the rails 76, 78 of the upper and lower glazing are adjacent when the lower glazing 44 is in the lowermost position. The upper glazing rail 76 incorporates a flexible wipe 80 that is retained in slot 82 of the upper glazing rail and that contacts the lower glazing rail 78 when the lower glazing 44 is in the lowermost position. The flexible wipe 80 runs the entire length of the rails 76, 78 and prevents the passage of wind driven water between the two rails 76, 78 thereby preventing intrusion of water into the interior of the structure. Immediately above the slot 82 on the upper glazing rail 76 is an upwardly extending flange 84 that underlays an overhanging downwardly extending flange 86 on the lower glazing rail 78. The upwardly extending flange 84 and the overhanging flange 86, both of which extend the entire length of the rails 76, 78, serve to supplement the role of the flexible wipe 80 in preventing the intrusion of water. The upper glazing rail 76 includes a step 88. It is from this step 88 that the flange 84 extends upwardly. Because of the outwardly extending step 88 a pocket 90 is created into which the downwardly extending flange 86 can nest. When the lower glazing is moved upward in its tracks, for example to ventilate a room, the immediately described structures, e.g., the flexible wipe 80 and flanges 84, 86, intended to prevent the intrusion of water are no longer engaged and cannot function as intended.

FIG. 2 also reveals the operating portion of the window 120 as seen in FIG. 1. The lower portion reveals the sill 2, the sill lock 32 and the base 34 of the sill lock 32. The sash 50 contains the glazing 44 and rides up and down within the tracks (not shown) of the window unit 100. The sash 50, when at the lowest level within the frame is restrained from movement outside of the plane of the glazing 44 by the sill tower 20 and the sill lock 32. The sill tower includes a slot 35 for housing a flexible fin-seal 36 that seals the window against undesirable air and water infiltration. The glazing 44 is held in position with the aid of glazing beads 58 that are anchored in slots 60 across the frame 100.

Figure 3:
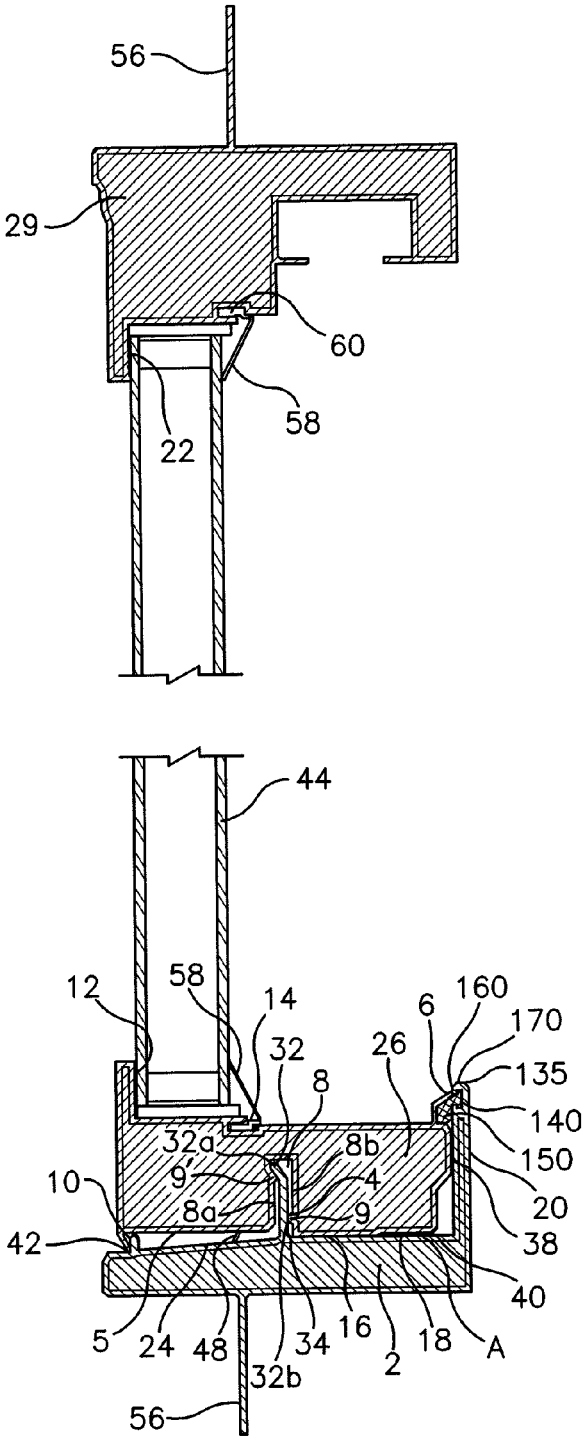
FIG. 3 is a cross sectional view taken along line 3-3 of FIG. 1 revealing an embodiment of a fixed full length glazing.

FIG. 3 provides a cross-sectional view of the fixed portion of the window at line 3-3. As seen in FIG. 3, the upper portion of the fixed window reveals the glazing 44 securely held in position by glazing beads 58 which presses the glazing 44 against the head 29 glazing leg 22.

Turning now to FIG. 3, the lower portion of this figure reveals a fixed glazing 44 held in position atop the sill cover 26 by glazing beads 58 which in turn are anchored in position in slot 14. The glazing 44 is pushed against the sill cover 26 glazing leg 12 thereby securing it in position. The sill cover 26 sets atop the sill 2 and the sill cover 26 includes a slot 8 extending longitudinally through the bottom surface 5 of the sill cover 26. The purpose of the longitudinally extending slot 8 is to receive and engage the longitudinally extending sill lock 32. The sill lock 32 is preferably extruded as part of the sill 2; however, the sill lock 32 does not extend the entire length of the sill 28 and is eliminated near the mull posts 33A and 33B (seen in FIG. 1). The slot 8 is comprised of a first wall 8*a* and a second wall 8*b*. The second wall 8*b* also includes a protrusion 9 extending outwardly from a lower portion of the wall 8*b*. The first wall 8*a* includes a second protrusion 9' extending outwardly near the top of the wall.

The sill lock 32 has a canted upper portion 32*a* that overlaps the protrusion 9' extending outwardly from the first wall 8*a*. Additionally, the sill lock 32 includes a longitudinally extending groove 32*b* proximate the sill 2 that is configured to engage protrusion 9. The overlap of the forward wall protrusion 9' by the sill lock canted portion 32*a* provides some protection against the intrusion of water driven by strong winds; however, as noted above, the sill lock 32 does not extend the entire distance between the mull posts 33*a*, 33*b* and is intended primarily as a structural component to resist strong winds.

The bottom surface 5 of the sill cover 26 includes a downwardly extending flexible wipe 48 that also extends longitudinally along the entire fixed center window assembly 110. The flexible wipe 48 is disposed between the front (exterior) edge of the sill 2 and the longitudinally extending slot 8. The wipe is preferably comprised of a flexible and resilient material such as polypropylene or flexible polyvinyl chloride (PVC) and is secured to the bottom surface 5 of the sill cover 26 with an adhesive, or alternatively, is configured to fit within a slot for retaining the wipe 48 in position.

The sill cover 26 also includes a longitudinally disposed downwardly extending rigid overlap 42 on the exterior side of window unit 100. The rigid overlap 42 is a short flange that folds downwardly at the lowermost exterior corner of the sill cover 26 to obstruct wind driven rain from gaining access to the gap between the sill cover 26 and the sill 2. The rigid overlap extends downwardly to and contacts the surface of the sill 2. To supplement the capacity of the rigid overlap 42 in keeping driven rain from entering the space between the sill 2 and the sill cover 26, the sill 2 also includes a screen retaining leg 10. The screen retaining leg 10 is a short upwardly extending flange. The rigid overlap 42 extends downwardly in front of the retaining leg 10 further enhancing the capability of the window 100 to retard entry of water between the sill 2 and the sill cover 26.

In order for rain driven by strong winds to gain access to the interior of the structure the water would have to move beyond the screen retaining leg 10 and the rigid overlap 42, then past the flexible wipe 48. Should water successfully pass beyond the screen retaining leg 10, the rigid overlap 42 and the flexible wipe 48 it would then have to pass an additional distance between the sill 2 and the sill cover 26 before encountering a pocket 40 that is optionally filled with a water resistant adhesive A. The adhesive A is spread longitudinally along the entire pocket 40 extending between the mull posts 33*a*, 33*b* preventing passage of water.

As further seen in FIG. 3, adjacent the adhesive pocket 40 is the sill tower 20 which provides a rigid backstop to the sill cover 26. The sill tower 20 extends upwardly from the back edge of the sill 2 and terminates at an upper edge 135. The sill tower 20 includes a longitudinally running slot 140 on the side of the tower 20 that faces the glazing 44. Slot 140 receives a fin-seal 150 that runs the entire length of the fixed window 110 and is obscured from sight by an overlapping sill cover flange 6. The outermost edge 170 of the sill cover flange 6 engages with the upper edge 160 of the longitudinally running slot 140 within the sill tower 20. The fin-seal 150 and the sill lock cover 6 provide one last measure of protection against wind driven water intrusion and because the sill cover flange 6 overlaps the fin seal and obscures the fin seal a pleasing appearance at the interior of the window is provided.

While the preferred form of the present invention has been shown and described above, it should be apparent to those skilled in the art that the subject invention is not limited by the figures and that the scope of the invention includes modifications, variations and equivalents which fall within the scope of the attached claims. Moreover, it should be understood that the individual components of the invention include equivalent embodiments without departing from the spirit of this invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A common window frame comprising:

a sill;

a sill lock, the sill lock further comprising a front face and a rear face the rear face having a longitudinally extending groove, and a sill tower, the sill tower extending upwardly from a back surface of the sill;

a header disposed atop the window frame;

at least one jamb running vertically between the header and sill;

at least one combination fixed-operating window frame; and at least one fully fixed window frame with a sill cover, the sill cover further comprising an upper surface, a lower surface and a longitudinally extending slot in the lower surface wherein the slot is configured with a forward wall and a rear wall for receiving the sill lock, the sill cover disposed atop the sill, the sill cover engaged with the sill lock and the sill tower.

2. The common window frame of claim 1, wherein the sill lock slot further comprises a longitudinally extending protrusion on the rear wall for interlocking with the groove of the sill lock.

3. The common window frame of claim 2, wherein the sill tower further comprises an upper end and a lower end, the upper end including a longitudinally extending opening, the longitudinally extending opening configured to receive a weather seal.

4. The common window frame of claim 3, wherein the sill cover upper surface further comprises an upwardly and rearwardly extending flange for engagement with the sill tower and for obscuring the weather seal from view.

5. The common window frame of claim 1, wherein a flexible wipe is secured to a bottom surface of the sill cover.

6. The common window frame of claim 1, wherein the at least one operating window frame further comprises an upper fixed window frame with a lower rail and a lower moveable window frame with an upper rail.

7. The common window frame of claim 6, wherein the upper rail of the lower moveable window frame further comprises a flexible wipe retained within a slot and an outwardly and upwardly extending flange adjacent the slot.

8. The common window frame of claim 7, wherein the lower rail of the upper fixed window frame further comprises a downwardly extending flange.

9. The common window frame of claim 8, wherein when the lower rail of the upper fixed window frame and the upper rail of the lower moveable window frame are adjacent one another the flexible wipe contained within the slot of the lower rail of the upper fixed window engages a surface of the upper rail of the lower moveable window frame thereby preventing the intrusion of moisture past the flexible wipe.

10. The common window frame of claim 8, wherein when the downwardly extending flange of the lower rail of the upper fixed window frame is adjacent the upwardly extending flange of the upper rail of the lower moveable window frame the flanges are further operable to prevent the intrusion of water past the flanges.

11. A common window frame comprising:

a sill;

a sill lock with a front face and a rear face wherein the rear face includes a longitudinally extending groove;

a sill cover with an upper surface, a lower surface and a longitudinally extending sill lock slot in the lower surface, the sill lock slot configured with a forward wall and a rear wall for receiving the sill lock, the sill lock slot further comprising a longitudinally extending protrusion on the rear wall for engagement with the longitudinally extending groove of the sill lock;

a sill tower upwardly extending from a back surface of the sill;

a head disposed atop the window frame;

at least one jamb;

at least one fixed glazing with the sill cover disposed atop the sill, the sill cover engaged with the sill lock and the sill tower; and at least one combination moveable and fixed window unit separated from the fixed window by at least one mull post.

12. The common window frame of claim 11, wherein the sill tower further comprises an upper end and a lower end, the upper end including a longitudinally extending opening, the longitudinally extending opening configured to receive a fin-seal.

13. The common window frame of claim 11, wherein the sill cover upper surface further comprises an upwardly and rearwardly extending flange for engagement with the sill tower and for obscuring the fin-seal from view.

14. The common window frame of claim 11, wherein a flexible wipe is secured to a bottom surface of the sill cover.

15. A common window frame comprising:

at least one fixed glazing within the common window frame;

at least one combination fixed and moveable combination glazing adjacent the fully fixed glazing;

a sill;

a sill lock with a front face and a rear face where in the rear face of the sill lock includes a longitudinally extending groove;

a sill tower, the sill tower upwardly extending from a back surface of the sill with an upper end and a lower end, the upper end further comprising longitudinally extending opening, the longitudinally extending opening configured to receive a weather seal;

a sill cover with an upper surface, a lower surface and a longitudinally extending slot in the lower surface, the slot further comprising a forward wall and a rear wall, the rear wall comprising a longitudinally extending protrusion for interlocking with the groove of the sill lock, the sill cover upper surface further comprising an upwardly and rearwardly extending flange for engagement with the upper end of the sill tower for obscuring the weather seal from view;

a head disposed atop the common window frame; and at least one mull post disposed between the fixed glazing and the at least one combination fixed and moveable glazing.

16. The common window frame of claim 15, wherein a flexible wipe is secured to a bottom surface of the sill cover.

17. The common window frame of claim 15, wherein the at least one operating window frame further comprises an upper fixed window frame with a lower rail and a lower moveable window frame with an upper rail.

18. The common window frame of claim 17, wherein the upper rail of the lower moveable window frame further comprises a flexible wipe retained within a slot and an outwardly and upwardly extending flange adjacent the slot.

19. The common window frame of claim 18, wherein the lower rail of the upper fixed window frame further comprises a downwardly extending flange.

20. The common window frame of claim 19, wherein when the lower rail of the upper fixed window frame and the upper rail of the lower moveable window frame are adjacent one another the flexible wipe contained within the slot of the lower rail of the upper fixed window engages a surface of the upper rail of the lower moveable window frame thereby preventing the intrusion of moisture past the flexible wipe.

21. The common window frame of claim 19, wherein when the downwardly extending flange of the lower rail of the upper fixed window frame is adjacent the upwardly extending flange of the upper rail of the lower moveable window frame the flanges are further operable to prevent the intrusion of water past the flanges.

* * * * *